US009370210B1

(12) United States Patent
Botelho

(10) Patent No.: US 9,370,210 B1
(45) Date of Patent: Jun. 21, 2016

(54) AUDIBLE NECKTIE ASSEMBLY

(71) Applicant: Gil C. Botelho, Mississauga (CA)

(72) Inventor: Gil C. Botelho, Mississauga (CA)

( * ) Notice: Subject to any disclaimer, the term of this patent is extended or adjusted under 35 U.S.C. 154(b) by 312 days.

(21) Appl. No.: 14/028,623

(22) Filed: Sep. 17, 2013

(51) Int. Cl.
*A41D 25/00* (2006.01)

(52) U.S. Cl.
CPC ..... *A41D 25/00* (2013.01)

(58) Field of Classification Search
CPC .... A41D 25/00; A41D 25/003; A41D 27/205
USPC ..... 2/144; 84/600; 362/103
See application file for complete search history.

(56) References Cited

U.S. PATENT DOCUMENTS 4,342,106 A 7/1982 Sato et al.
4,525,878 A * 7/1985 Lowe, Jr. ..... A42B 1/004 2/195.1
4,531,310 A * 7/1985 Acson ..... A44C 15/0015 40/1.5
4,703,573 A * 11/1987 Montgomery ..... B42D 1/007 40/124.03
4,823,240 A * 4/1989 Shenker ..... A41D 27/08 362/103
4,875,238 A 10/1989 Solomon et al.
4,990,092 A * 2/1991 Cummings ..... G09B 5/062 40/455
5,073,987 A * 12/1991 Crosier ..... A41D 25/00 2/144
D337,429 S 7/1993 Grieco
5,278,734 A * 1/1994 Ferber ..... A41D 27/085 362/103
5,410,746 A * 4/1995 Gelber ..... A42B 1/245 2/209.13
5,435,011 A * 7/1995 Nicolai ..... A41D 25/00 2/144
5,437,552 A * 8/1995 Baer ..... G09B 5/062 434/308
5,455,749 A * 10/1995 Ferber ..... A41D 1/005 362/103
5,510,961 A * 4/1996 Peng ..... A42B 1/242 2/209.12
5,625,903 A * 5/1997 Schultz ..... A61F 9/029 2/209
5,626,948 A * 5/1997 Ferber ..... A63H 3/28 200/262
5,784,733 A * 7/1998 Rasamny ..... A41D 27/08 446/81
5,802,613 A * 9/1998 Marshall ..... A41D 27/20 2/144
5,806,098 A * 9/1998 McKinnon ..... A41D 27/20 2/144
5,927,842 A * 7/1999 Preisler ..... A41D 25/00 362/103
5,956,682 A * 9/1999 Loudermilk ..... A47G 1/0616 40/717
6,148,173 A * 11/2000 Bell ..... G09B 5/04 40/455

(Continued)

*Primary Examiner* — Alissa L Hoey

(57) ABSTRACT

An audible necktie assembly provides an audible response at the press of a button for purposes of amusement and entertainment. The assembly includes an elongated necktie configured for being worn around a neck of a user. A pocket is coupled to the necktie. A housing is positioned within the pocket. A sound emitter is mounted in the housing and is configured to emit audible sound. A plurality of control buttons is provided and comprises outer buttons and inner buttons. Each of the inner buttons is electrically coupled to the sound emitter wherein manipulating a selectable one of the inner buttons causes the sound emitter to emit audible sound. Each of the outer buttons is positioned adjacent an associated one of the inner buttons when the housing is positioned within the pocket such that manipulation of a selectable one of the outer buttons activates an associated one of the inner buttons.

1 Claim, 5 Drawing Sheets

(56) References Cited

U.S. PATENT DOCUMENTS 6,336,730 B1 * 1/2002 Hong ..... A41D 25/00 362/103
6,525,706 B1 * 2/2003 Rehkemper ..... G09B 5/06 345/87
6,693,515 B2 * 2/2004 Clapper ..... G09F 25/00 340/10.1
6,865,367 B2 * 3/2005 Kim ..... B42D 3/123 345/901
7,044,615 B2 * 5/2006 Gesten ..... A42B 1/245 2/209.13
D534,333 S 1/2007 Jones
8,011,122 B2 * 9/2011 Clegg ..... B42D 15/022 40/124.03
8,250,674 B2 * 8/2012 Higgins ..... A42B 1/245 2/209.13
8,670,587 B2 * 3/2014 Townsend ..... H04R 1/02 381/386
8,677,515 B2 * 3/2014 Ishihara ..... A44C 5/0015 2/125
8,875,317 B2 * 11/2014 Jacobs ..... A42B 1/245 2/209.13
2002/0108162 A1 8/2002 Bolds-Leftridge
2002/0139139 A1 10/2002 Cohen
2006/0206990 A1 * 9/2006 Demus ..... A41D 27/205 2/247
2007/0021073 A1 1/2007 Gratton
2007/0226876 A1 * 10/2007 Foust ..... A42B 1/245 2/171
2007/0245444 A1 * 10/2007 Brink ..... A41D 1/005 2/69
2008/0060114 A1 3/2008 Joseph
2009/0100570 A1 * 4/2009 Tuan ..... A41D 27/085 2/122
2009/0193565 A1 * 8/2009 Wilens ..... A42B 1/245 2/209.13
2009/0210995 A1 * 8/2009 Kwon ..... A42B 1/245 2/209.13
2010/0031424 A1 * 2/2010 Sharpe ..... A42B 1/48 2/209.11
2010/0077531 A1 * 4/2010 Sale ..... A41D 27/205 2/144
2010/0315367 A1 * 12/2010 Moy ..... A41D 27/085 345/173
2011/0088142 A1 * 4/2011 Holley ..... A42B 1/245 2/209.13
2011/0119812 A1 * 5/2011 Genz ..... F21V 33/0008 2/244
2011/0197742 A1 * 8/2011 Liotta ..... H04R 1/1033 84/725
2011/0216931 A1 9/2011 Bui
2012/0305770 A1 12/2012 Minera
2014/0053315 A1 * 2/2014 Pond ..... A41D 1/002 2/144

* cited by examiner

AUDIBLE NECKTIE ASSEMBLY

BACKGROUND OF THE DISCLOSURE

Field of the Disclosure

The disclosure relates to necktie assemblies and more particularly pertains to a new necktie assembly for providing an audible response at the press of a button for purposes of amusement and entertainment.

SUMMARY OF THE DISCLOSURE

An embodiment of the disclosure meets the needs presented above by generally comprising an elongated necktie configured for being worn around a neck of a user. A pocket is coupled to the necktie. A housing is positioned within the pocket. A sound emitter is mounted in the housing and is configured to emit audible sound. A plurality of control buttons is provided and comprises outer buttons and inner buttons. Each of the inner buttons is electrically coupled to the sound emitter wherein manipulating a selectable one of the inner buttons causes the sound emitter to emit audible sound. Each of the outer buttons is positioned adjacent an associated one of the inner buttons when the housing is positioned within the pocket such that manipulation of a selectable one of the outer buttons activates an associated one of the inner buttons.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
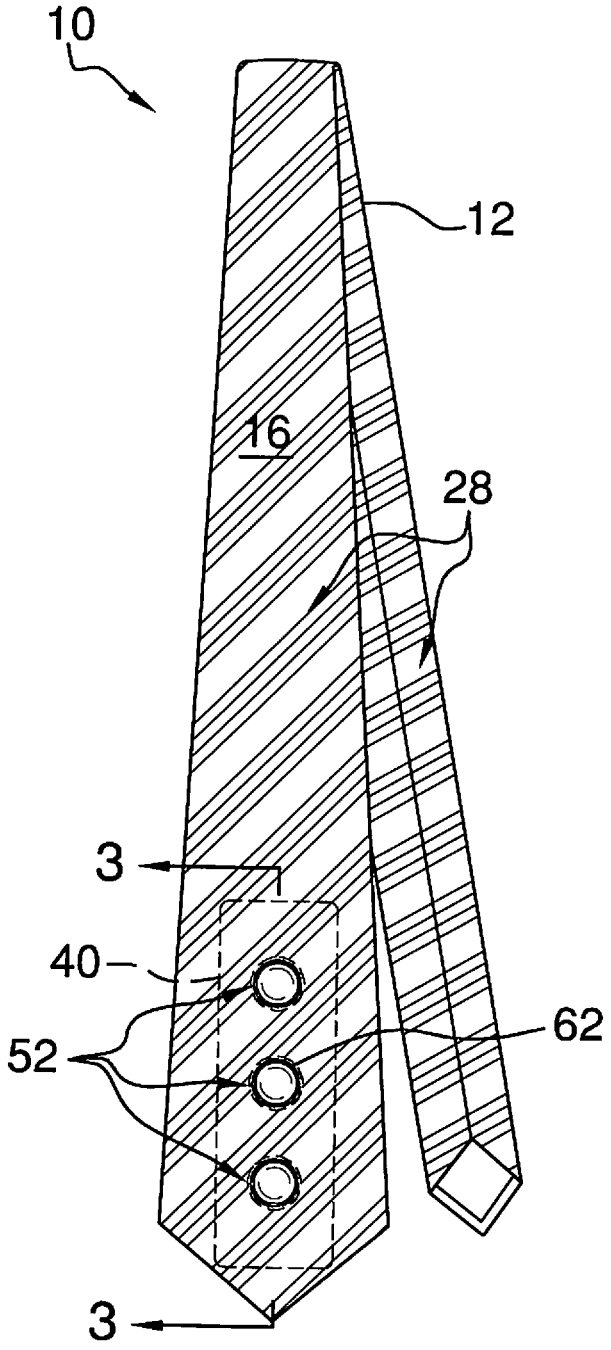
FIG. 1 is a front view of an audible necktie assembly according to an embodiment of the disclosure.
Figure 2:
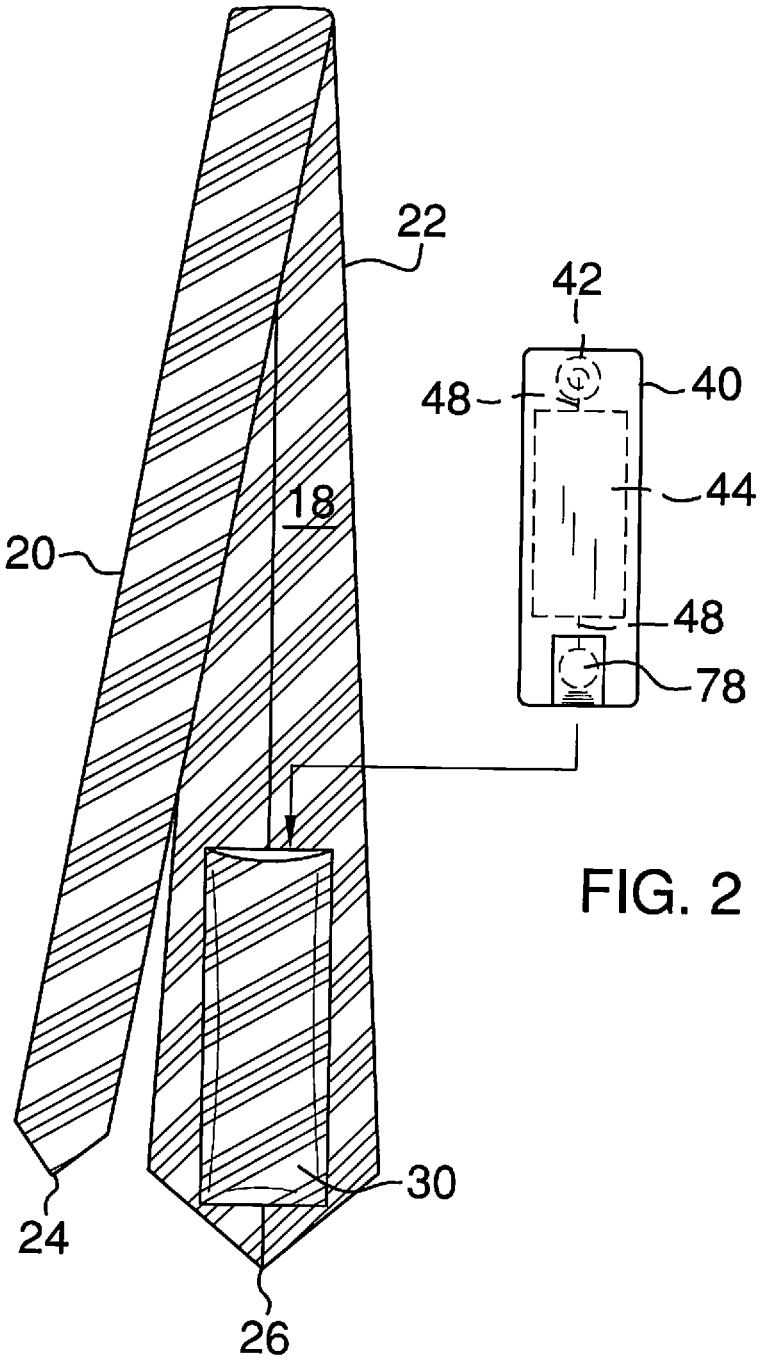
FIG. 2 is a back view of an embodiment of the disclosure.
Figure 3:
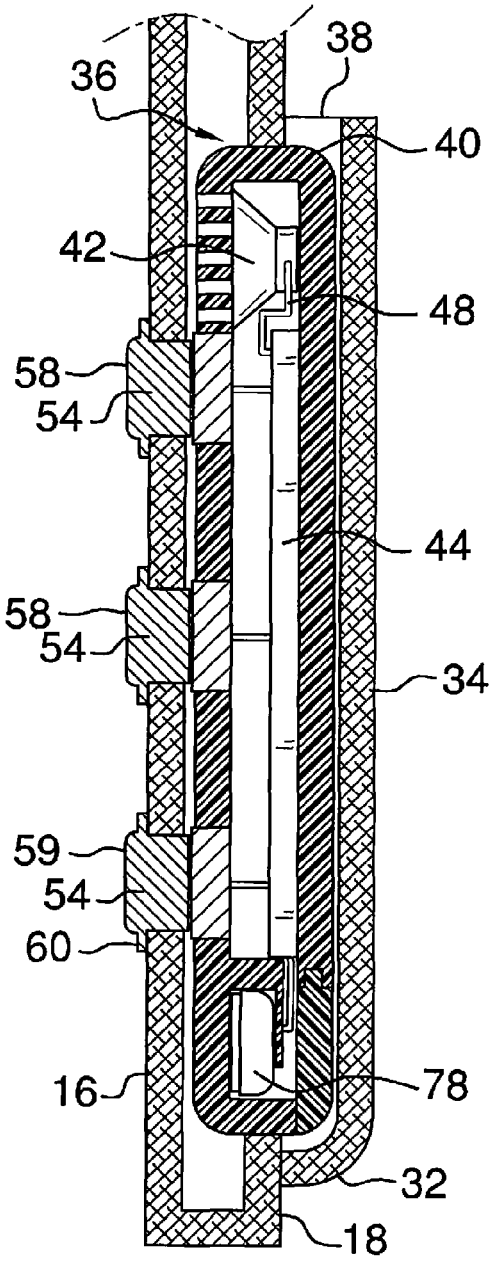
FIG. 3 is a cross-sectional view of an embodiment of the disclosure taken along line 3-3 of FIG. 1.
Figure 4:
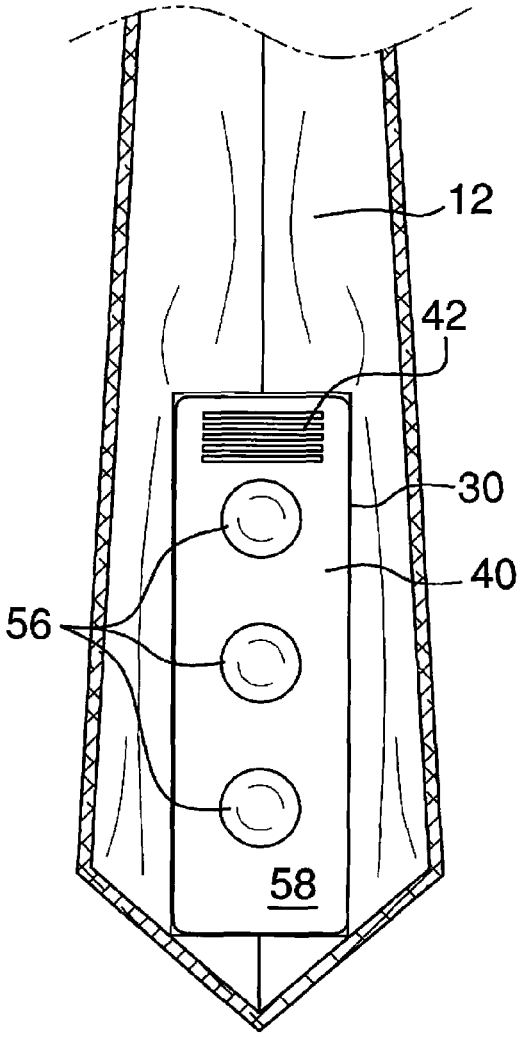
FIG. 4 is a cross-sectional view of an embodiment of the disclosure similar to FIG. 3 except that FIG. 4 shows a view from a front of the necktie.
Figure 5:
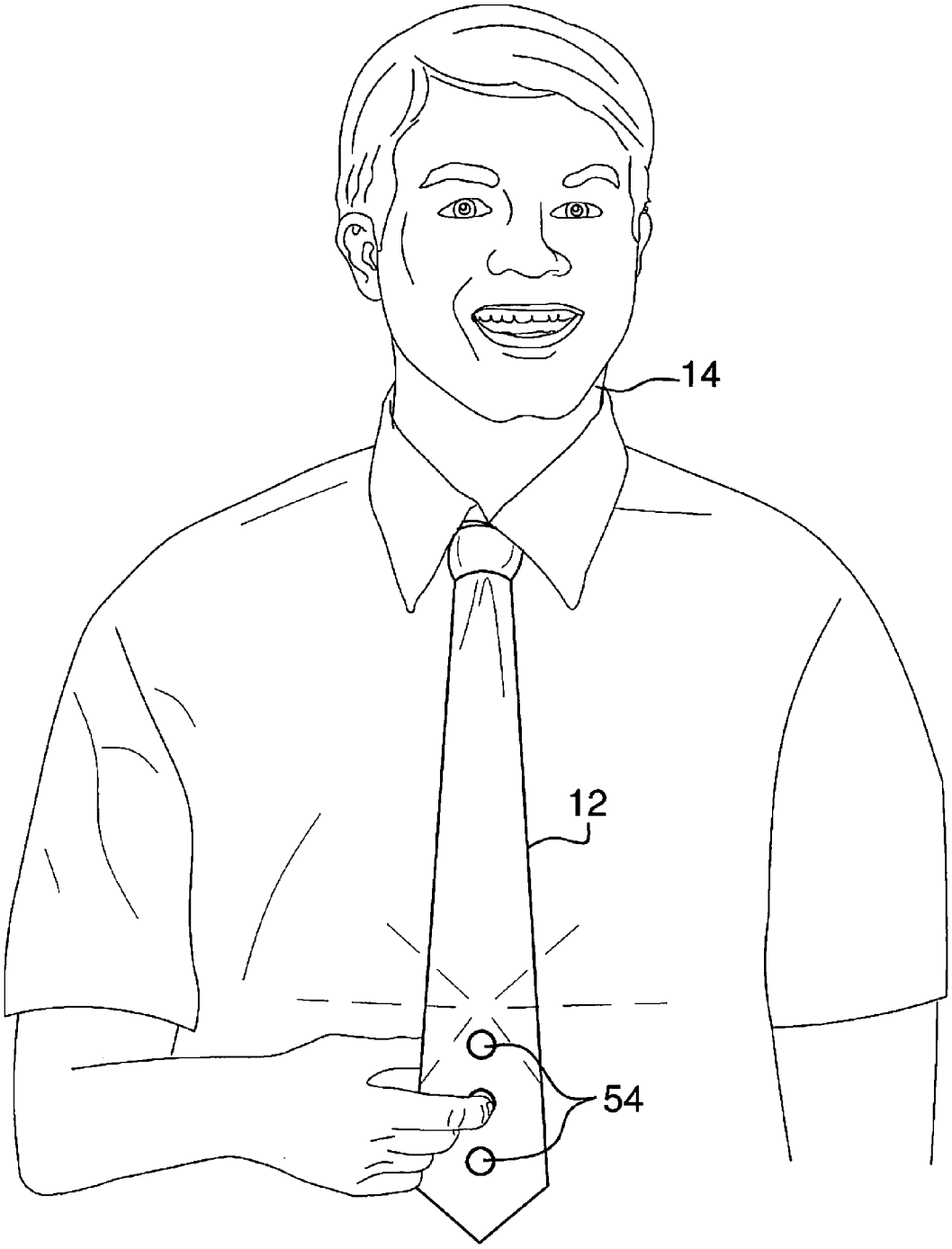
FIG. 5 is an in-use front view of an embodiment of the disclosure.
Figure 6:
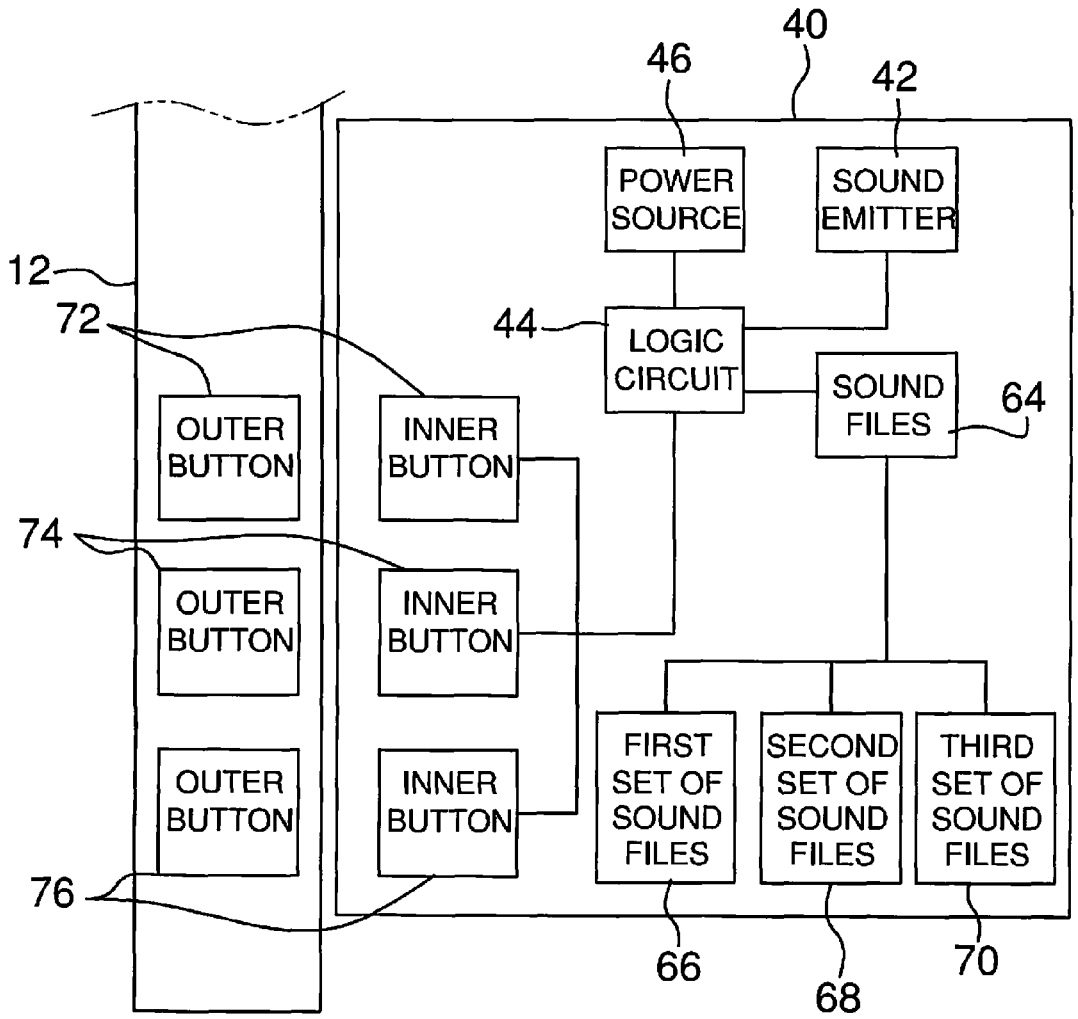
FIG. 6 is a schematic block diagram of an embodiment of the disclosure.

With reference now to the drawings, and in particular to FIGS. 1 through 6 thereof, a new necktie assembly embodying the principles and concepts of an embodiment of the disclosure and generally designated by the reference numeral 10 will be described.

As best illustrated in FIGS. 1 through 6, the audible necktie assembly 10 generally comprises an elongated necktie 12 configured for being worn around a neck 14 of a user. The necktie 12 has a front surface 16, a back surface 18, an upper portion 20 and a lower portion 22. The necktie 12 is of a conventional type. Thus, the upper portion 20 may include a pointed top end 24 and the lower portion 22 may include a pointed bottom end 26. Moreover, the upper portion 20 may be narrower than the lower portion 22. In addition, decorative indicia 28, such as stripes or checkered patterns, may be positioned on and extend across each of the front surface 16 and back surface 18 of the necktie 12.

A pocket 30 is coupled to the necktie 12. The pocket 30 has a closed bottom end 32 and a perimeter wall 34 attached to and extending upwardly from the closed bottom end 32. The closed bottom end 32 is coupled to the back surface 18 of the necktie 12 and may be positioned proximate the pointed bottom end 24 of the necktie 12. A void 36 may extend into the back surface 18 of the necktie 12. The void 36 is positioned between the front surface 16 of the necktie 12 and the perimeter wall 34 of the pocket 30. An opening 38 is positioned between the back surface 18 of the necktie 12 and the perimeter wall 34 of the pocket 30. The opening 38 provides an access opening into the void 36.

A housing 40 is positionable within the void 36. A sound emitter 42 is mounted in the housing 40 and is configured to emit audible sound. A logic circuit 44 is also mounted in the housing 40 and is electrically coupled to the sound emitter 42. The logic circuit 44 accesses a database of sound files 64 and audibly plays one of the sound files 64 with the sound emitter 42 when the logic circuit 44 is activated. The sound files 64 may comprise a first set of sound files 66, a second set of sound files 68 and a third set of sound files 70. The first set of sound files 66 may be configured to comprise a decision response. Thus, the first set of sound files 66 may comprise a combination of "yes" and "no" type replies. The second set of sound files 68 may be configured to comprise an initiating response intended to make conversation with another. Thus, the second set of sound files 68 may pose a question or provide a statement, including such phrases such as "How are you?", "Nice shirt!" or the like. The third set of sound files 70 may be configured to comprise an agreeable response. Thus, the third set of sound files 70 may include phrases such as "That's great!"; "Of course!", "You're right!" or the like.

A power source 46 is mounted in the housing 40 and is electrically coupled to the logic circuit 44. The power source 46 is configured to supply power to the logic circuit 44 to activate the logic circuit 44. The power source 46 may comprise at least one rechargeable battery 78. Wiring 48 may operationally couple the logic circuit 44 to each of the power source 46 and the sound emitter 42. A plurality of holes 50 extends through the front surface 16 of the necktie 12. The holes 50 may be spaced and vertically aligned.

A plurality of control buttons 52 is provided. The control buttons 52 comprise a plurality of outer buttons 54 and a plurality of inner buttons 56. The inner buttons 56 may be mounted to a front face 58 of the housing 40. Each of the outer buttons 54 extends through an associated one of the holes 50 such that the outer buttons 54 are accessible from the front surface 16 of the necktie 12. Each of the inner buttons 56 is electrically coupled to the logic circuit 44 wherein manipulating a selectable one of the inner buttons 56 activates the logic circuit 44. Each of the outer buttons 54 is positioned adjacent an associated one of the inner buttons 56 when the housing 40 is positioned within the void 36 such that manipulation of a selectable one of the outer buttons 54 activates an associated one of the inner buttons 56. Each of the control buttons 52 may be circular or have any other suitable shape. A top surface 59 of each of the outer buttons 54 may be convexly arcuate. A lip 60 is coupled to and extends around a circumferential edge 62 of each of the outer buttons 54. Each of the lips 60 is configured to retain the associated outer button 54 in position against the front surface 16 of the necktie 12.

The logic circuit 44 is activated to cause the sound emitter 42 to audibly play one of the sound files 64 from the first set of sound files 66 when an upper pair 72 of the outer 54 and inner 56 buttons is manipulated. Thus, the upper pair 72 of the outer 54 and inner 56 buttons is manipulated to achieve a "yes" or "no" type of response. Continuing, the logic circuit 44 is activated to cause the sound emitter 42 to audibly play one of the sound files 64 from the second set of sound files 68 when a middle pair 74 of the outer 54 and inner 56 buttons is manipulated. Thus, the middle pair 74 of the outer 54 and inner 56 buttons is manipulated when a user desires to make conversation with another without having to speak himself. Lastly, the logic circuit 44 is activated to cause the sound emitter 42 to audibly play one of the sound files 64 from the third set of sound files 70 when a bottom pair 76 of the outer 54 and inner 56 buttons is manipulated. Thus, the bottom pair 76 of the outer 54 and inner 56 buttons is manipulated when a user desires to audibly provide an agreeable response. Manipulation of the control buttons 52 may cause the sound emitter 42 to play the sound files 64 in a particular sequence or, alternatively, the sound files 64 may instead be played randomly.

In use, as stated above and shown in the Figures, the necktie 12 is positioned around a neck 14 of a user. The housing 40 is positioned within the void 36 such that each of the outer buttons 54 is positioned adjacent an associated one of the inner buttons 56. As described above, a selectable one of the control buttons 52 is manipulated to cause the sound emitter 42 to emit a desired audible response. In this manner, the assembly 10 emits audible phrases for purposes of amusement and entertainment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An audible necktie assembly comprising:

an elongated necktie configured for being worn around a neck of a user, said necktie having a front surface, a back surface, an upper portion and a lower portion, said upper portion including a pointed top end, said lower portion including a pointed bottom end, said upper portion being narrower than said lower portion;

a pocket coupled to said necktie, said pocket having a closed bottom end and a perimeter wall attached to and extending upwardly from said closed bottom end, said closed bottom end being coupled to said back surface of said necktie proximate said pointed bottom end of said necktie;

a void extending into said back surface of said necktie, said void being positioned between said front surface of said necktie and said perimeter wall of said pocket;

an opening being positioned between said back surface of said necktie and said perimeter wall of said pocket, said opening providing an access opening into said void;

a housing, said housing being positionable within said void;

a sound emitter being mounted in said housing and being configured to emit audible sound;

a logic circuit being mounted in said housing and electrically coupled to said sound emitter, said logic circuit accessing one of a plurality of sound files and audibly playing said associated sound file with said sound emitter when said logic circuit is activated, said sound files comprising a plurality of words and phrases, said sound files including a first set of sound files, a second set of sound files and a third set of sound files;

a power source mounted in said housing and being electrically coupled to said logic circuit, said power source being configured to supply power to said logic circuit to activate said logic circuit, said power source comprising at least one rechargeable battery;

wiring electrically coupling said logic circuit to said power source and said sound emitter;

a plurality of holes extending through said front surface of said necktie, said holes being spaced and vertically aligned;

a plurality of control buttons, said control buttons comprising a plurality of outer buttons and a plurality of inner buttons, said inner buttons being mounted to a front face of said housing, each of said outer buttons extending through an associated one of said holes such that said outer buttons are accessible from said front surface of said necktie, each of said inner buttons being electrically coupled to said logic circuit wherein manipulating a selectable one of said inner buttons activates said logic circuit, each of said outer buttons being positioned adjacent an associated one of said inner buttons when said housing is positioned within said void such that manipulation of a selectable one of said outer buttons activates an associated one of said inner buttons, each of said control buttons being circular, a top surface of each of said outer buttons being convexly arcuate;

wherein said logic circuit is activated to cause said sound emitter to audibly play one of said sound files from said first set of sound files when an upper pair of said outer and inner buttons is manipulated;

wherein said logic circuit is activated to cause said sound emitter to audibly play one of said sound files from said second set of sound files when a middle pair of said outer and inner buttons is manipulated;

wherein said logic circuit is activated to cause said sound emitter to audibly play one of said sound files from said third set of sound files when a bottom pair of said outer and inner buttons is manipulated;

a lip coupled to and extending around a circumferential edge of each of said outer buttons, each of said lips being configured to retain said associated outer button in position against said front surface of said necktie; and decorative indicia positioned on said front surface of said necktie.

* * * * *